US006761428B2

(12) United States Patent
Agarwal et al.

(10) Patent No.: US 6,761,428 B2
(45) Date of Patent: Jul. 13, 2004

(54) INDEPENDENT WIPING OF PRINTHEAD

(75) Inventors: Manish Agarwal, Singapore (SG); Michael Nordlund, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/201,437

(22) Filed: Jul. 22, 2002

(65) Prior Publication Data

US 2004/0012651 A1 Jan. 22, 2004

(51) Int. Cl.[7] ..... B41J 2/165
(52) U.S. Cl. ..... 347/33; 347/32
(58) Field of Search ..... 347/22, 23, 24, 347/29–32, 35

(56) References Cited

U.S. PATENT DOCUMENTS 6,139,128 A * 10/2000 Magirl et al. ..... 347/22

* cited by examiner

*Primary Examiner*—Shih-wen Hsieh

(57) ABSTRACT

In a method for independently wiping a first and a second printhead of an inkjet printing mechanism, a first and a second wiping assembly separated from each other are provided in the printing mechanism. Furthermore, the wiping of the first printhead by the first wiper and the wiping of the second printhead by the second wiper are separately controlled.

10 Claims, 4 Drawing Sheets

INDEPENDENT WIPING OF PRINTHEAD

This invention relates generally to inkjet printing mechanisms, and in particular to techniques for maintaining inkjet printheads at its optimal conditions.

Inkjet printing mechanisms such as thermal inkjet printers and piezoelectric printers use pens which shoot drops of liquid colorant, referred to generally herein as "ink," onto a media sheet. Each pen has a printhead formed with very small nozzles through which the ink drops are fired. To print an image, each printhead is propelled back and forth across the media sheet, shooting drops of ink in a desired pattern as it moves. The particular ink ejection mechanism within the printhead may take on a variety of different forms known to those skilled in the art, such as those using piezoelectric or thermal printhead technology.

To clean and protect the printhead, typically a conventional "wiping assembly" mechanism is mounted within the housing of the printing mechanism so the printheads can be moved to a wiping region over the assembly for maintenance, specifically for wiping off ink residue as well as any paper dust or other debris that has collected on the printheads. Normally, a printhead needs wiping after a certain amount of printing operations or a certain period of idleness.

For a printing mechanism having more than one printhead, all the printheads move to the wiping region together. Conventionally, several flexible wiper-blades in close proximity to each other are provided in the conventional wiper assembly to wipe all the printheads simultaneously.

However, different printheads may have different needs for maintenance due to different characteristics and usage during printing operations. The fact that one printhead needs wiping normally does not justify the wiping of the other printheads. If all the printheads are wiped at the same time whenever one of them needs wiping, the printheads may be exposed to excessive amount of wiping. Potentially, such excessive wiping of the printheads may deteriorate the health of the printheads.

Therefore, there is a need for an improved printhead wiping mechanism which optimizes the amount of wiping for different printheads.

SUMMARY

According to an aspect of the present invention, in a method for independently wiping a first and a second printhead of an inkjet printing device, a first and a second wiping assembly separated from each other are provided in the printing mechanism. Furthermore, the wiping of the first printhead by the first wiper and the wiping of the second printhead by the second wiper are separately controlled.

According to a second aspect of the present invention, a method for wiping a first and a second printhead of an inkjet printing mechanism is provided. A first and a second wiper are movable to a wiping region in the printing mechanism and correspond to the first and second printheads respectively. Furthermore, each wiper is individually adjustable. During wiping operations, both printheads are moved to the wiping region facing the wipers. In addition, a character of the first wiper, that is, its position relative to its corresponding printhead, is adjusted prior to wiping of any printheads. Subsequently, both wipers are driven along a wiping axis such that the second printhead is wiped by the second wiper, with the first printhead not being simultaneously wiped by the first wiper due to this adjustment prior to the wiping operation.

According to a further aspect of the invention, an inkjet printing mechanism includes a chassis, a pair of printheads, a pair of wipers movable to a wiping region for wiping the printheads, and a carriage that transports both printheads to the wiping region facing the wipers. Each wiper corresponding to one of the printheads respectively, and each wiper is individually adjustable such that each printhead can be independently wiped with the other printhead not being simultaneously wiped by its corresponding wiper.

Other aspects and advantages of the invention will become apparent from the following detailed description in conjunction with the accompanying drawings; the description illustrates by way of example the principles of the invention.

DETAILED DESCRIPTION

Figure 1:
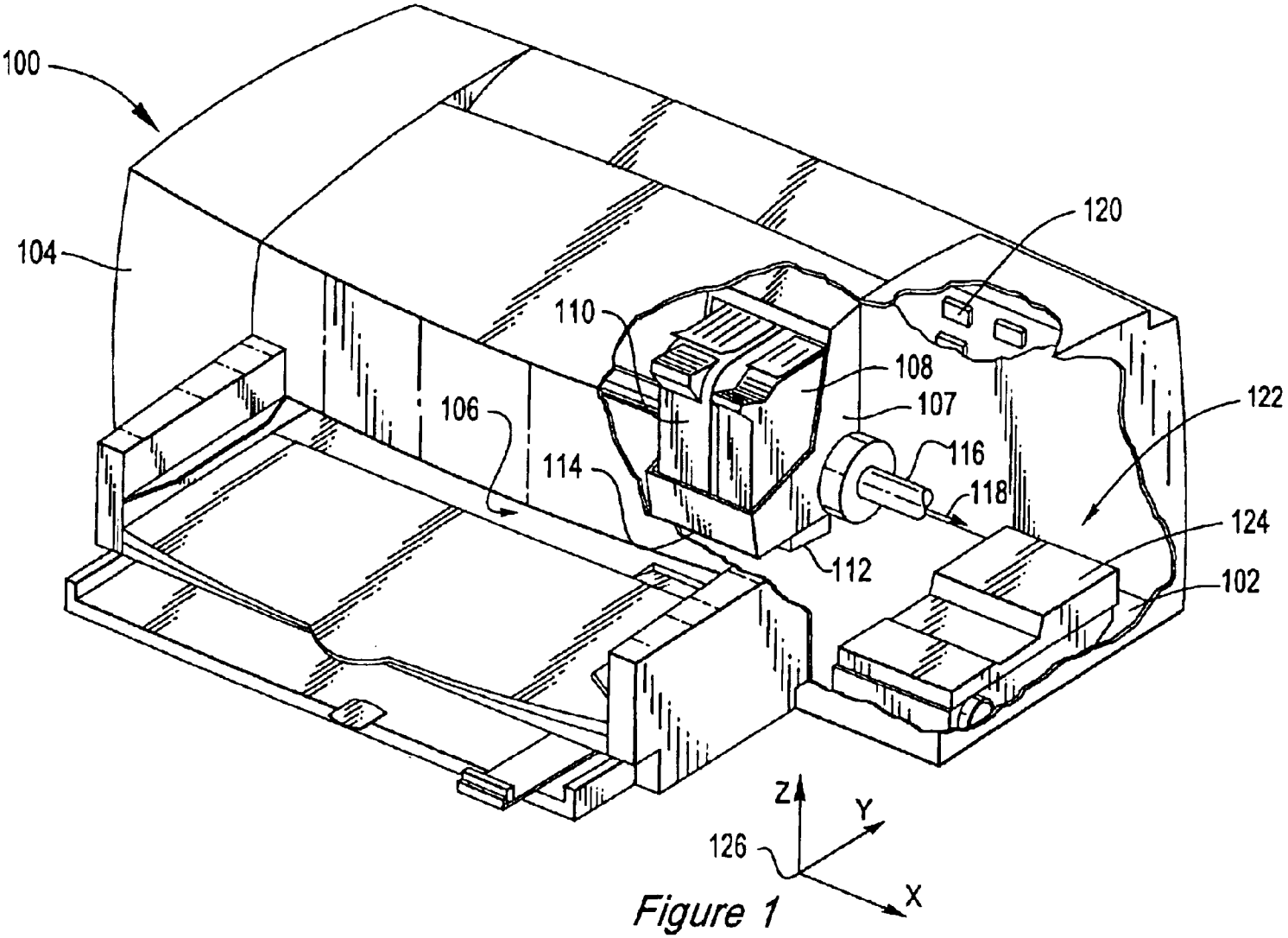
FIG. 1 is a fragmented, partially schematic, perspective view of an inkjet printing mechanism having an exemplary embodiment of the present invention.

For convenience, the concepts of the present invention are illustrated in the environment of an inkjet printer 100, while it is understood that the present invention as illustrated by the exemplary embodiment can also be used in other printing mechanisms using ink printing technologies such as facsimile machines and copiers.

The typical inkjet printer includes a chassis 102 surrounded by a housing or casing enclosure 104.

The printer 100 also has a printer controller, illustrated schematically as a microprocessor 120, that receives instructions from a host device, typically a computer, such as a personal computer (not shown), and manages different operations of different components of the printer 100.

A carriage guide rod 116 is supported by the chassis 102 to support an inkjet carriage 107 for reciprocating sliding motion along a scanning axis 118. The scanning axis 118 is defined by the guide rod 116 extending across a printing area 106 within which images are imprinted onto media sheets. A conventional carriage propulsion system may be used to drive the carriage 107, including a position feedback system which communicates carriage position signals to the controller 120. For instance, a carriage drive gear and DC motor assembly (not shown) may be coupled to drive an endless belt (not shown) secured in a conventional manner to the carriage 107, with the motor operating in response to control signals received from the printer controller 120. To provide carriage positional feedback information to the printer controller 120, an optical encoder reader (not shown) may be mounted to the carriage 107 to read an encoder strip (not shown) extending along the path of carriage travel.

In the printing area 106, the media sheet receives ink from an inkjet cartridge, such as a black ink cartridge 108 and/or a color ink cartridge 110. The cartridges 108, 110 are also often called "pens" by those in the art and are typically contained in the carriage 107. The illustrated color pen 110 is a tricolor pen, although in some embodiments, a set of discrete monochrome pens may be used. Furthermore, for the purpose of this description, the color pen 110 is defined to be located on the left side of the black pen 108 as shown in FIG. 1.

Each of the illustrated pens 108, 110 includes a reservoir for storing a supply of ink. The pens 108, 110 also have a printhead 112, 114; each printhead 11, 114 has an orifice plate with a plurality of nozzles formed therethrough in a manner well-known to those skilled in the art. Ink drops are ejected from the nozzles to the media sheet during printing operations. The illustrated printheads 112, 114 are thermal inkjet printheads, although other types of printheads, such as piezoelectric printheads, may be used. Preferably, the outer surface of the printheads 112, 114 lies in a common printhead plane, which may serve as a reference place.

Other components are arranged within the casing 104 for handling media sheets and imprinting images on the media sheets. A detailed description of the various printer components and their function is not provided herein, since they are generally understood by those with ordinary skill in the art.

The carriage 107 is propelled along the guide rod 116 into a servicing region 122 located within the interior of the casing 104. The servicing region houses a service station 124, which provides various conventional printhead servicing functions. Only wiping of the printheads is discussed in the current application. A detailed description of other functions is not provided herein, since it is generally understood by those with ordinary skill in the art.

Figure 2:
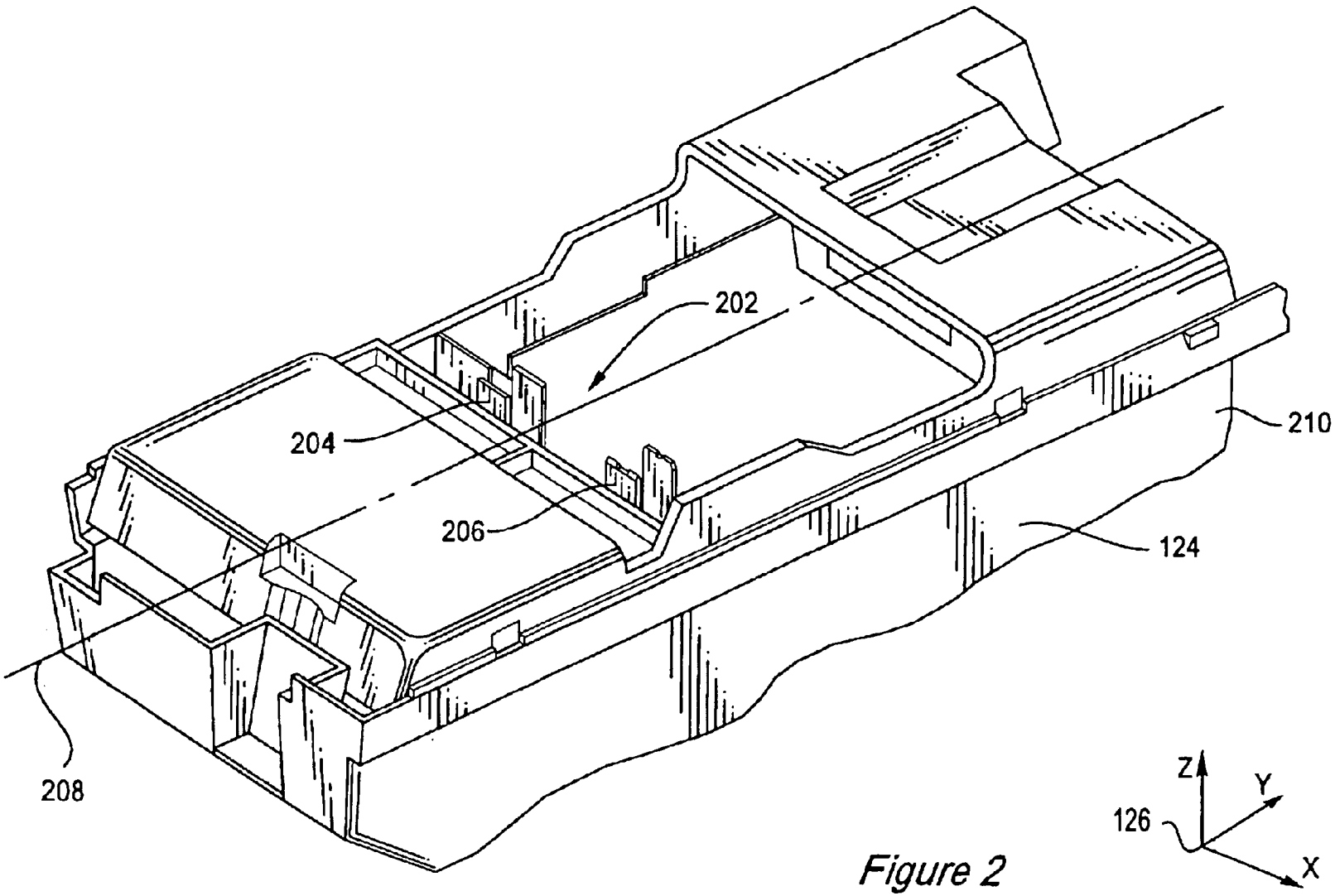
FIG. 2 is a fragmented perspective view partially illustrating a service station of FIG. 1, in which an exemplary embodiment of the present invention of a wiping mechanism is embedded.

In FIG. 2, an exemplary wiping mechanism 202 in the service station 124 is provided; the wiping mechanism 202 includes a left and a right wiper 204, 206 adjacent to each other. The left and right wipers are positioned in the service station 124 so that they are to be in contact with the printheads of the color pen 110 and the black pen 108 respectively when the carriage has moved to the servicing region 122 for servicing (see FIG. 1). Wiping of the printheads is accomplished by back-and-forth movements of the wipers in the service station 124 in the direction along a wiper axis 208 such that a wiper end 318, 320 describes a plane which is parallel to the printhead plane.

Furthermore, each wiper is adjustable in the vertical, or Z direction, which is perpendicular to the printhead plane as shown by the XYZ coordination axis 126 in FIGS. 1 and 2. In this way, each wiper can be individually spaced from its respective printhead in the Z direction. As a result, independent wiping of each printhead can be achieved. Specifically, for example, when only the color pen printhead 114 in the carriage 107 as shown in FIG. 1 needs wiping, both pens move to the servicing region 122. Simultaneously, the controller 120 as shown in FIG. 1 controls to space, or position, the right wiper 206 from the black pen printhead 112 in the vertical, or Z direction. Due to such a spacing, during subsequent back-and-forth movements of the wipers along the wiper axis 208, the right wiper 206 is not in contact with the black pen printhead 112. As a result, the black pen printhead 112 is not wiped during this wiping routine.

The controller 120 of FIG. 1 records the status of each wiper and therefore is capable of determining which wiper needs adjusting in the Z direction. For example, consider that only the color pen printhead 114 (see FIG. 1) is wiped in the preceding wiping, or servicing, routine. In a succeeding servicing routine, if both printheads need wiping, the controller 120 controls driving the right wiper 206 towards the printhead plane in the Z direction so that the right wiper 206 can engage with the black pen printhead 112 during the succeeding servicing routine. Meanwhile, the left wiper remains in a position to be in contact with the color pen printhead 114. However, if only the black pen printhead 112 needs wiping during the succeeding servicing routine, in addition to the adjustment of the right wiper, the controller 120 also needs to position or space the left wiper 204 from the color pen printhead 114 in the vertical or Z direction, Different mechanisms can be used to adjust the spacing or position of the wipers in the Z direction. Shown in FIGS. 3 and 4 is one exemplary adjusting mechanism 300 used in the exemplary embodiment of the wiping mechanism 202 in FIG. 2.

Figure 3:
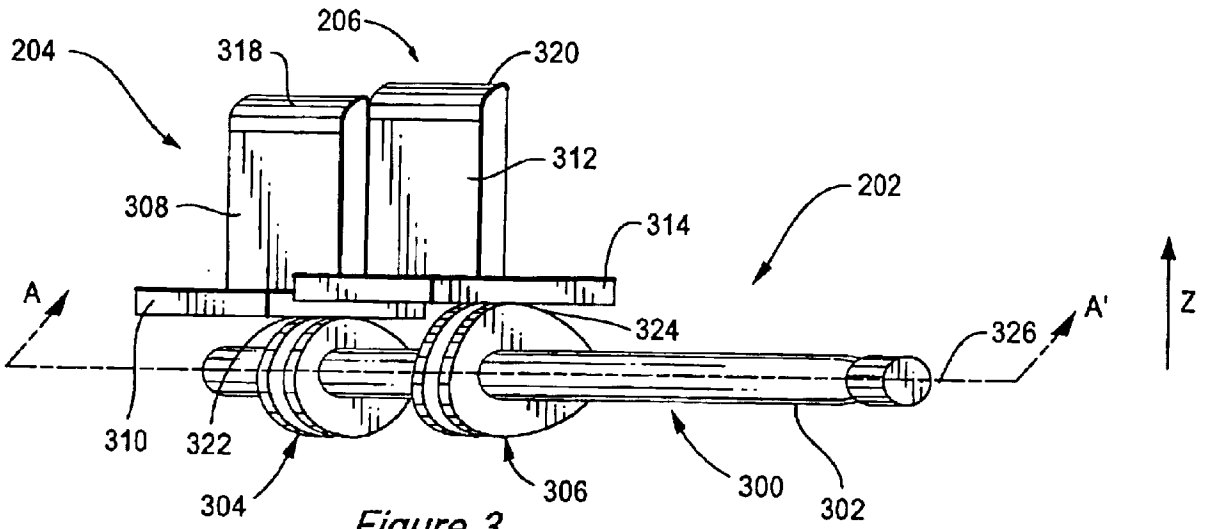
FIG. 3 is a perspective view of the wiping mechanism in FIG. 2.
Figure 4:
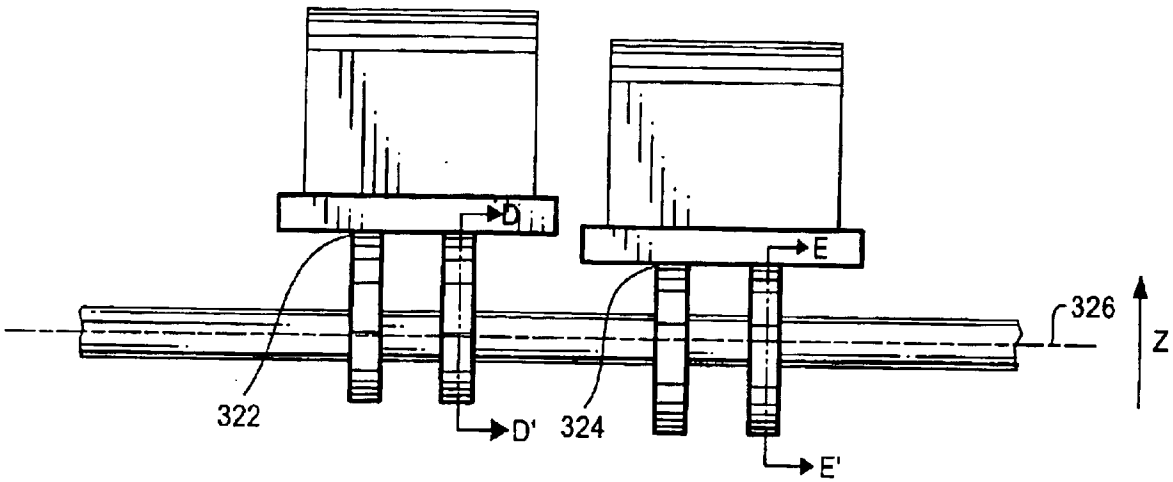
FIG. 4 is a cross section view along A–A' of the wiping mechanism in FIG. 3.

In FIGS. 3 and 4, each wiper 204, 206 has a flexible wiper blade 308, 312 for wiping printheads. Each wiper blade rests atop a left and a right platform 310, 314, respectively, and both platforms are movable in the Z direction. By adjusting the relative position of each platform in Z direction, each wiper can be adjusted in the Z direction to engage or to not engage with their respective printhead during a wiping operation.

The adjusting mechanism 300 of the wiping mechanism 202 includes a left and a right cam 304, 306 that are mounted to and rotate together with a cam shaft 302. The shaft 302 is rotatably mounted to the service station frame 124 (see FIG. 2) of the service station. Each cam is positioned below and designed to be in contact with one of the platforms for adjusting the wipers 204, 206 in the Z direction. A spring (not shown) with two ends attached to one of the platforms and passing through the cam shaft 302 can be used for biasing the cam shaft towards the platforms. In this way, each cam can be held tightly in contact with its respective platform at a respective contacting point 322, 324.

Since the cam shaft 302 is mounted to the service station frame, the spacing in the Z direction between the shaft 302 and the printhead plane is fixed. Furthermore, the length of the wiper blades and the thickness of the platform in the Z direction are also fixed. Thus, the spacing in the Z direction between the wiping end 318, 320 of each wiper blade and its respective printhead is determined by the distance between the axis 326 about which the cam shaft 302 rotates and the respective cam-platform contacting point 322, 324. By adjusting the spacing between the axis and the respective contacting point, each wiper position is adjusted in the Z direction.

In the exemplary embodiment, desired adjustments of the spacing between the axis and the contacting points are achieved by the design of the profile of the cam and the rotation of the cam shaft. For a printer having two pens and two respective wipers like the exemplary embodiment, the cam shaft is designed to rotate among three positions. Accordingly, each cam provides three points along its profile for contacting its respective platform. Since both cams are mounted to the cam shaft, each cam alternatively contacts its respective platform at one of these three points when the cam shaft rotates among the three positions. By preselecting the distance, or spacing, between each point and the center of the cam, desired adjustments of the wiper position in the Z direction are achieved.

Figure 5B:
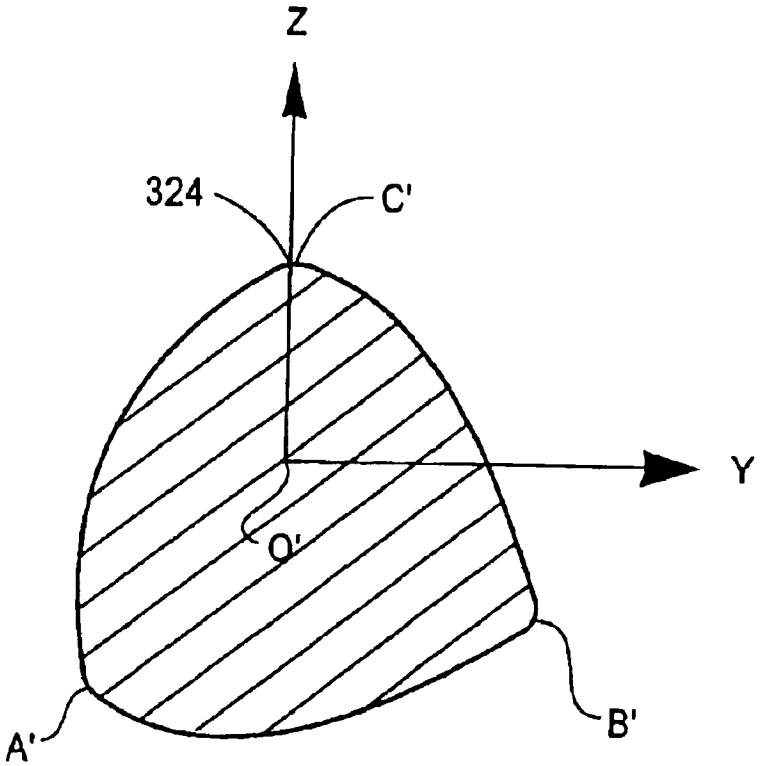
FIG. 5B is a cross section view along E–E' of a right cam in FIG. 4.
Figure 5A:
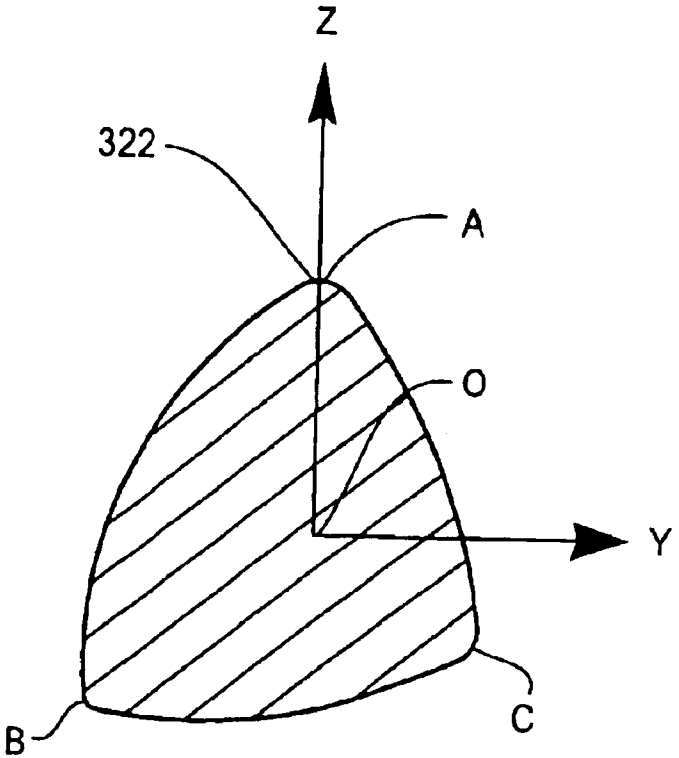
FIG. 5A is a cross section view along D–D' of a left cam in FIG. 4.

Both cams have a common profile, but they are mounted to the cam shaft with different orientations. A cross section view of the profile of the left cam along line D—D' (see FIG. 4) is shown in FIG. 5*a*; a cross section view of the profile of the left cam along line E—E' (see FIG. 4) is shown in FIG.

5*b*. Each cam has a center O, O' through which the axis 326 (see FIG. 4) of the cam shaft passes, and provides contacting points along its profile.

Take the left cam for example. The left cam provides three points along its profile, namely, A, B and C. The spacing between point A and the center O is the same as the spacing between point B and center O, but larger than the spacing between point C and center O. When the left cam is in contact with the left platform at point A or B, the left wiper is in a position to engage the color pen printhead 114 during wiping operations. However, if the left cam is in contact with the left platform at its point C, due to the relatively short spacing between point C and its center O, the left platform is spaced relatively far away from the printhead in the Z direction. Consequently, a gap (not shown) in the Z direction is created between the left wiper and the color pen printhead 114, and this left pen will not be wiped during the succeeding wiping operation.

Similarly, the right cam provides three contacting points A' B' and C'. The spacing between these points and its center O' is about the same as the spacing between the contacting points A, B and C of the left cam and its center O. Adjusting of the right cam in the Z direction is similarly achieved by selecting at which point the right cam contacts the right platform.

Both cams rotate together with the cam shaft. In addition, the cams are oriented so that the right cam contacts the right wiper at point A' when the left cam contacts the left wiper at point B, at point B' when the left cam contacts the left wiper at point C, and at point C' when the left cam contacts the left wiper at point A.

If the printer decides that only one of the printheads, for example, the color pen printhead needs wiping during a wiping operation, the controller controls to rotate the cam shaft to the extent such that the left cam comes into contact with the left platform at point A. As previously discussed, the right cam will be in contact with the right platform at point C' at the same time. Therefore, during wiping operations, the left wiper engages the color pen printhead, while the right wiper does not engage the black pen printhead. In this way, independent wiping of the color pen printhead is achieved. This situation is illustrated in FIG. 4.

In the case when only the black pen printhead needs wiping, the controller controls rotating the cam shaft so that the left cam comes into contact with the left platform at point C. At this time, the right cam will be in contact with the right platform at point B', and independent wiping of the black pen printhead is achieved.

If both printheads need wiping, the controller controls rotating the cam shaft so that the left cam comes into contact with the left platform at point B. This time, the right cam is in contact with the right platform at point A'. Both printheads will be wiped during the subsequent wiping operation.

If neither printhead needs wiping, no movement of the carriage is required.

Rotation of the cam shaft and the cams can be accomplished wtih a DC motor (not shown) coupled to the cam shaft. By controlling the DC motor, the cam shaft and the cams can be rotated to the desired positions. Other mechanisms, for example, a mechanism to transfer the linear movements of the carriage along the scanning axis 118 into the rotation of the cam shaft about its axis 326, can also be used as an alternative to the use of additional electrical components.

Alternatives can be made to the above exemplary embodiments. For example, instead of the cams and cam shaft, a pair of motors each coupled to one of the platforms can be used for adjusting the wipers in the Z direction to the desired positions.

In addition, each printhead defines a printhead plane; these planes are parallel to each other but may be offset in the Z direction. In that case, the profiles of the respective cams may need to be adjusted accordingly.

Furthermore, only a two-pen printer is discussed in the exemplary embodiment. It is understood that the claimed invention is also suitable for other inkjet printing mechanisms having more than two pens, though certain further modifications may be needed. For example, more cams may be needed for the increase of printheads if a similar adjusting mechanism is used. Also, the cam profile combination needs to be redesigned.

What is claimed is:

1. A method for wiping a first and a second printhead of an inkjet printing mechanism, comprising:

providing a first and a second wiper movable to a wiping region in the printing mechanism, the first and second wipers corresponding to the first and second printheads respectively and each wiper being individually adjustable;

moving both printheads to the wiping region each facing its corresponding wipers during subsequent wiping operations;

adjusting a character of the first wiper prior to wiping of any printheads; and driving both wipers along a wiping axis such that the second printhead is wiped by the second wiper, with the first printhead not being simultaneously wiped by the first wiper due to the prior adjustment of the first wiper.

2. The method of claim 1, further comprising determining which of the first and second printheads does not need wiping, selecting one of the wipers that corresponds to the printhead that does not need wiping, and adjusting the spacing between the printhead that does not need wiping and the selected one of the wipers, wherein the selected wiper is the first wiper.

3. The method of claim 1, wherein the step of adjusting includes adjusting spacing between the first wiper and the first printhead such that they are not in contact during the wiping of the second printhead.

4. An inkjet printing mechanism, comprising:

a chassis, a pair of printheads, a pair of wipers movable to a wiping region for wiping the printheads, each wiper corresponding to one of the printheads respectively, and supported by the chassis, a carriage that transports both printheads to the wiping region each facing its respective corresponding wipers during wiping operations, wherein each wiper is individually adjustable such that each printhead can be independently wiped with the other printhead not being simultaneously wiped by its corresponding wiper.

5. The printing mechanism of claim 4, further comprising:

means for determining which of the pair of printheads does not need wiping, and means for selecting one of the wipers that corresponds to the printhead that does not need wiping, and means for adjusting spacing between the printhead that does not need wiping and the selected wiper.

6. The printing mechanism of claim 4, further comprising:

means for adjusting spacing between one of the pair of wipers and its corresponding printhead such that they are not in contact during the wiping of the other of the pair of printheads.

7. The printing mechanism of claim 6, wherein the adjusting means includes a pair of cams each having a profile and each being in contact with one of the pairs of wipers for individually determining a position of each wiper relative to its corresponding printhead.

8. The printing mechanism of claim 7, wherein both cams have a common profile but are oriented at different angles on a common shaft.

9. The printing mechanism of claim 8, wherein at least one of the printheads defines a printhead plane, wherein both cams are mounted to a common rotatable shaft, wherein the distance between the shaft and the printheads in a direction perpendicular to the printhead plane is fixed, and wherein the position of each wiper relative to its corresponding printhead is determined by the orientation of the cam with which the wiper is in contact.

10. The printing mechanism of claim 9, further comprising means for rotating the shaft for altering the orientation of each cam.

* * * * *